US006799083B2

(12) United States Patent
Chen et al.

(10) Patent No.: US 6,799,083 B2
(45) Date of Patent: Sep. 28, 2004

(54) ON-LINE FIBER ORIENTATION CLOSED-LOOP CONTROL

(75) Inventors: Shih-Chin Chen, Dublin, OH (US); Ravi Subbarayan, Dublin, OH (US); Peter Q. Tran, Dublin, OH (US)

(73) Assignee: ABB Inc., Norwalk, CT (US)

( * ) Notice: Subject to any disclaimer, the term of this patent is extended or adjusted under 35 U.S.C. 154(b) by 352 days.

(21) Appl. No.: 10/080,203

(22) Filed: Feb. 21, 2002

(65) Prior Publication Data

US 2003/0171838 A1 Sep. 11, 2003

(51) Int. Cl.[7] ..... G06F 19/00
(52) U.S. Cl. ..... 700/128
(58) Field of Search ..... 700/122–129, 700/167; 226/27, 28, 45; 162/199, 238, 262, 263, 272, 352, 354, 374

(56) References Cited

U.S. PATENT DOCUMENTS 4,648,712 A * 3/1987 Brenholdt ..... 356/73
4,730,931 A * 3/1988 Watson ..... 356/429
4,841,223 A * 6/1989 Baum et al. ..... 324/631
4,955,720 A * 9/1990 Blecha et al. ..... 356/429
5,394,247 A * 2/1995 Vahey et al. ..... 356/429
5,748,467 A * 5/1998 Qin et al. ..... 700/50
5,827,399 A * 10/1998 Neittaanmaki et al. ..... 162/198
5,833,808 A * 11/1998 Shands et al. ..... 162/198
6,179,964 B1 * 1/2001 Begemann et al. ..... 162/198
6,322,666 B1 * 11/2001 Luontama et al. ..... 162/198

* cited by examiner

*Primary Examiner*—Albert W. Paladini
*Assistant Examiner*—Chad Rapp
(74) *Attorney, Agent, or Firm*—Michael M. Rickin, Esq.

(57) ABSTRACT

A controller to provide base level fiber orientation control of a paper web. The controller achieves one or more indices that are derived from the online measurements of a fiber orientation sensor of the fiber ratio and the fiber angle. The indices are used for control of the sheet forming processes. The controller may be implemented by a single or multi stage fuzzy controller or the combination of fuzzy controllers with non-fuzzy logic controllers.

18 Claims, 11 Drawing Sheets

Block diagram of base FO control (BFOC) system (10)

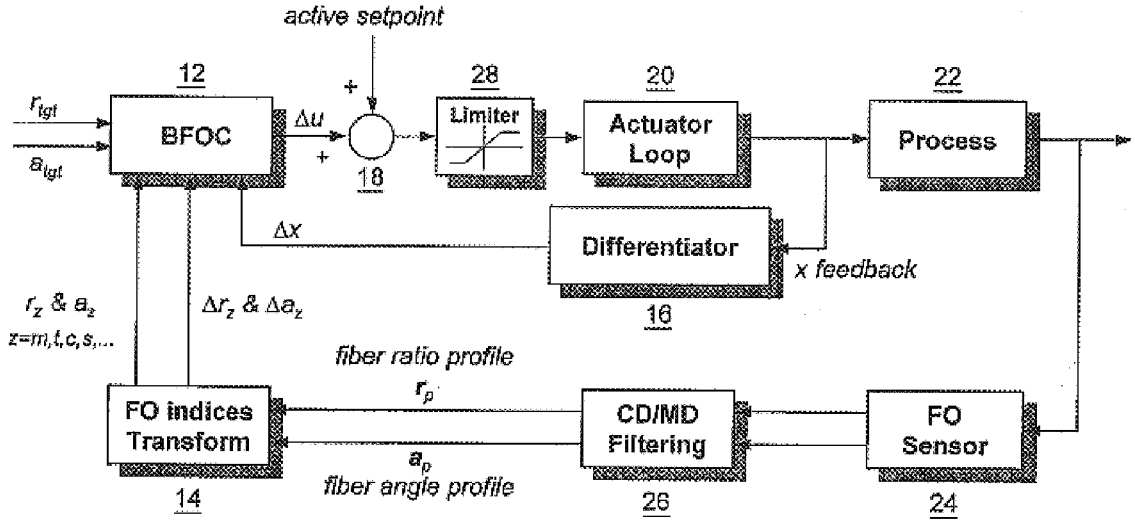
Fig. 1 Block diagram of base FO control (BFOC) system (10)

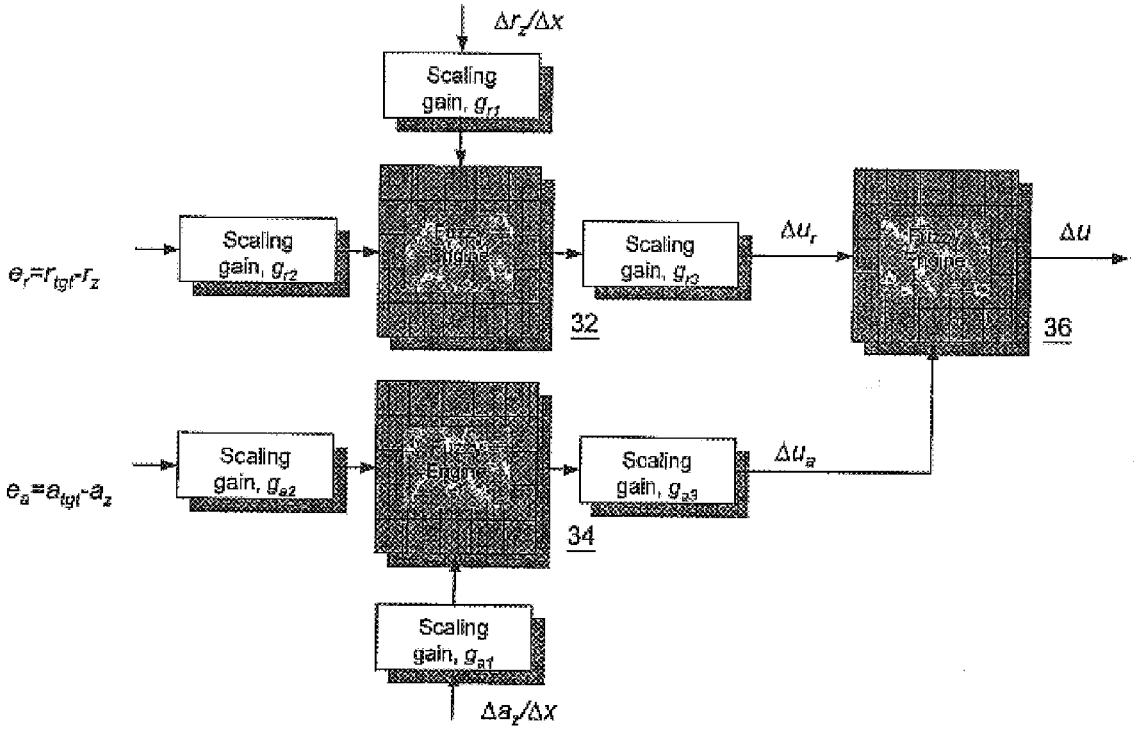
Fig. 2 Base FO controller (BFOC) implementation: embodiment 1 (30)

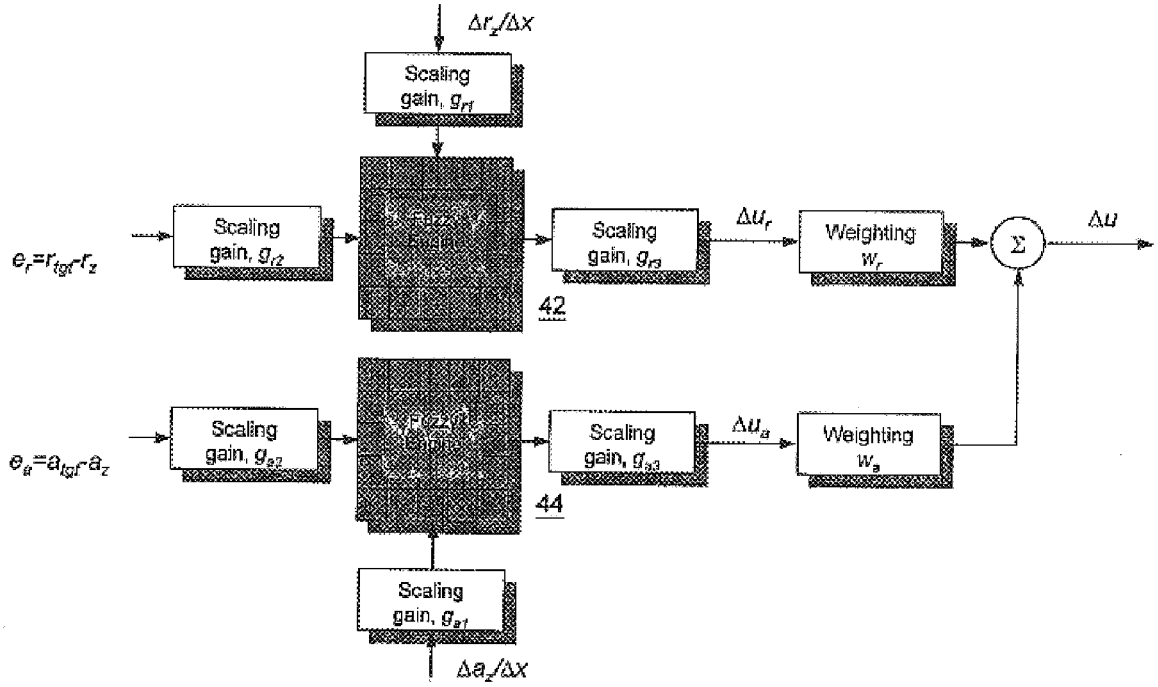
Fig. 3 Base FO controller (BFOC) implementation: embodiment 2 (40)

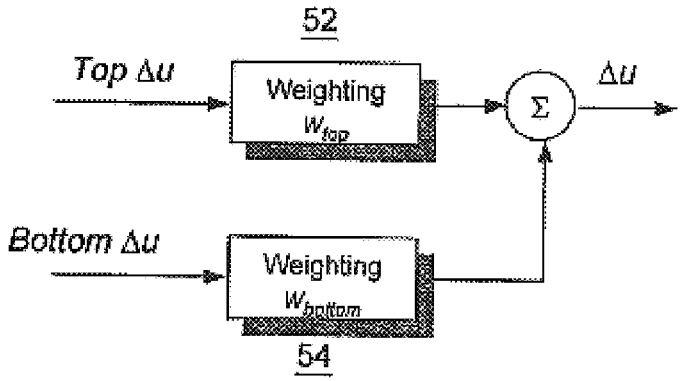
Fig. 4 Base FO controller (BFOC) for single headbox output (50)

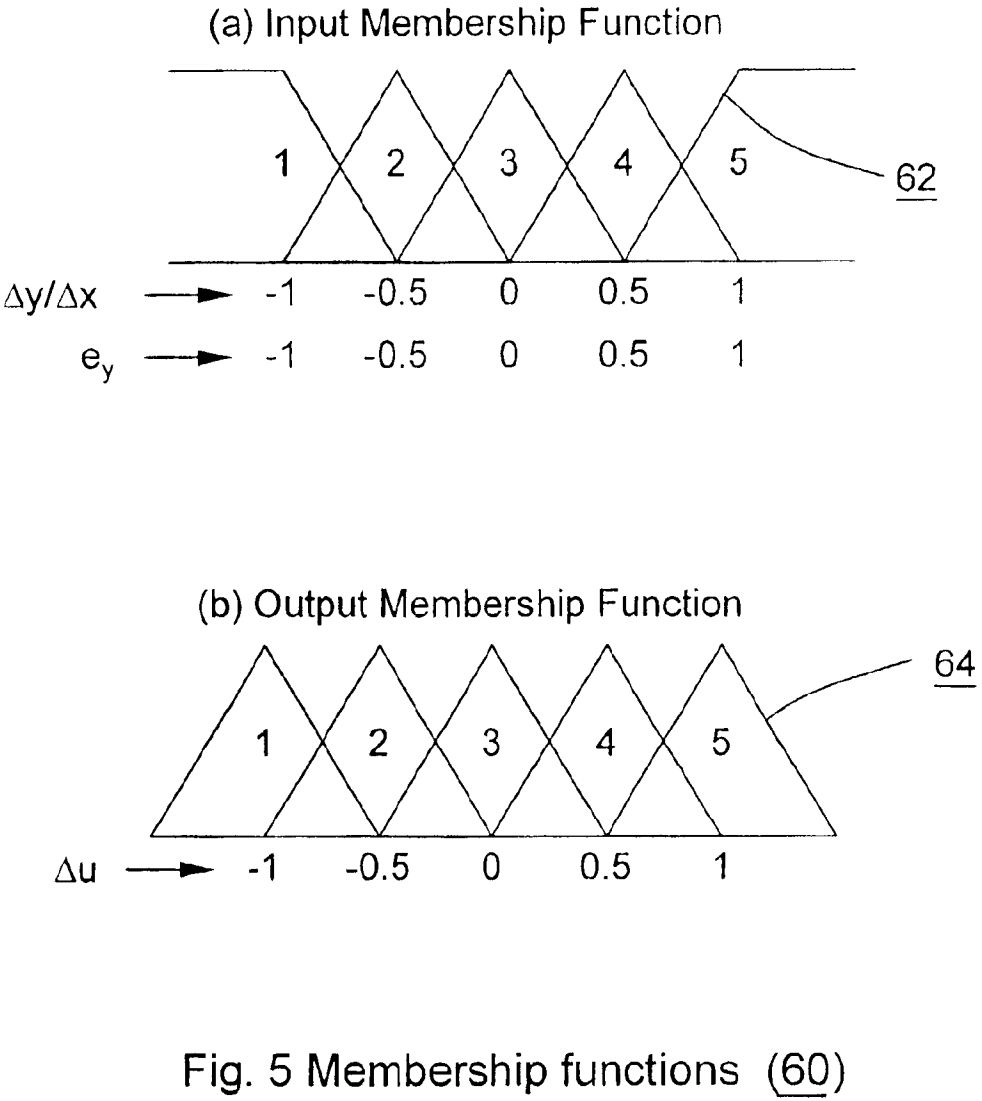
Fig. 5 Membership functions (60)

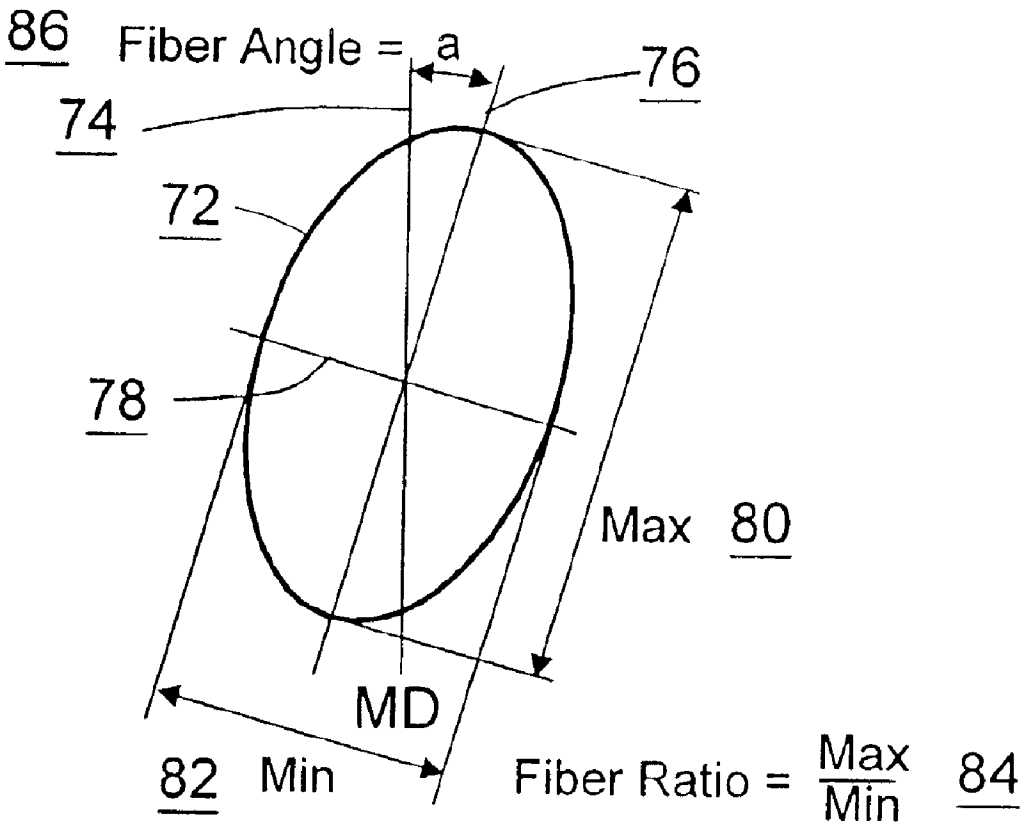
Fig. 6 FO definition (70)

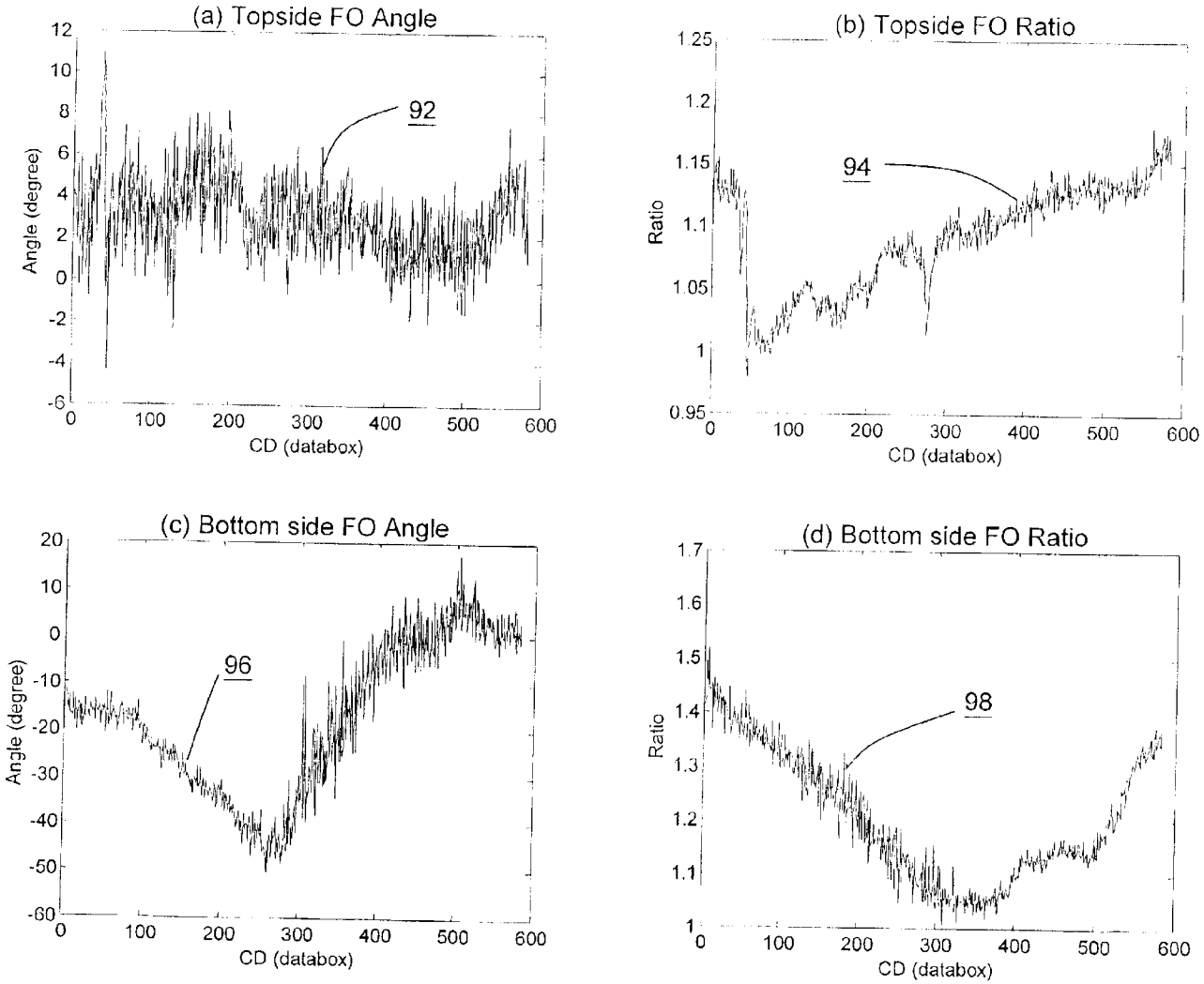
Fig. 7 Four FO profiles measured from an on-line FO scanning sensor (90)

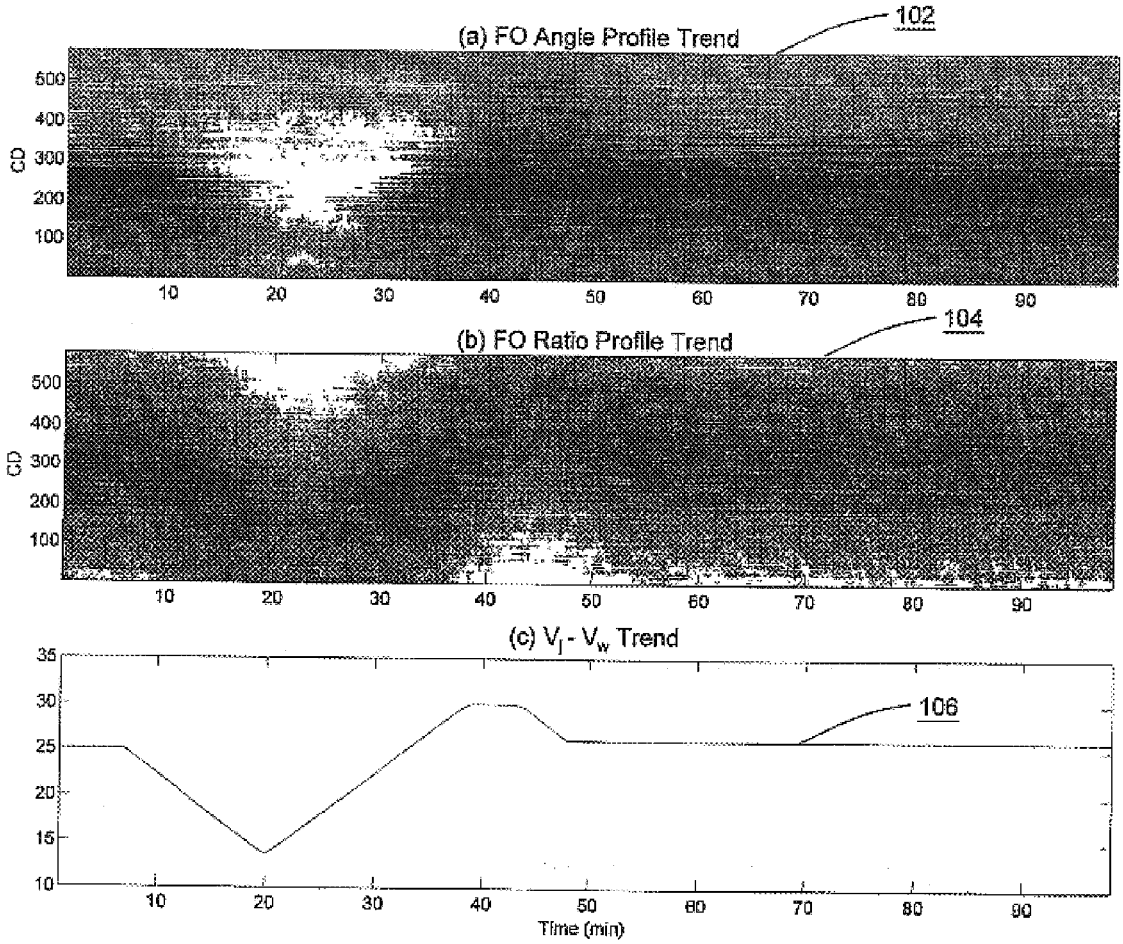
Fig. 8 Two FO profile contours and $V_{jw}$ trend (100)

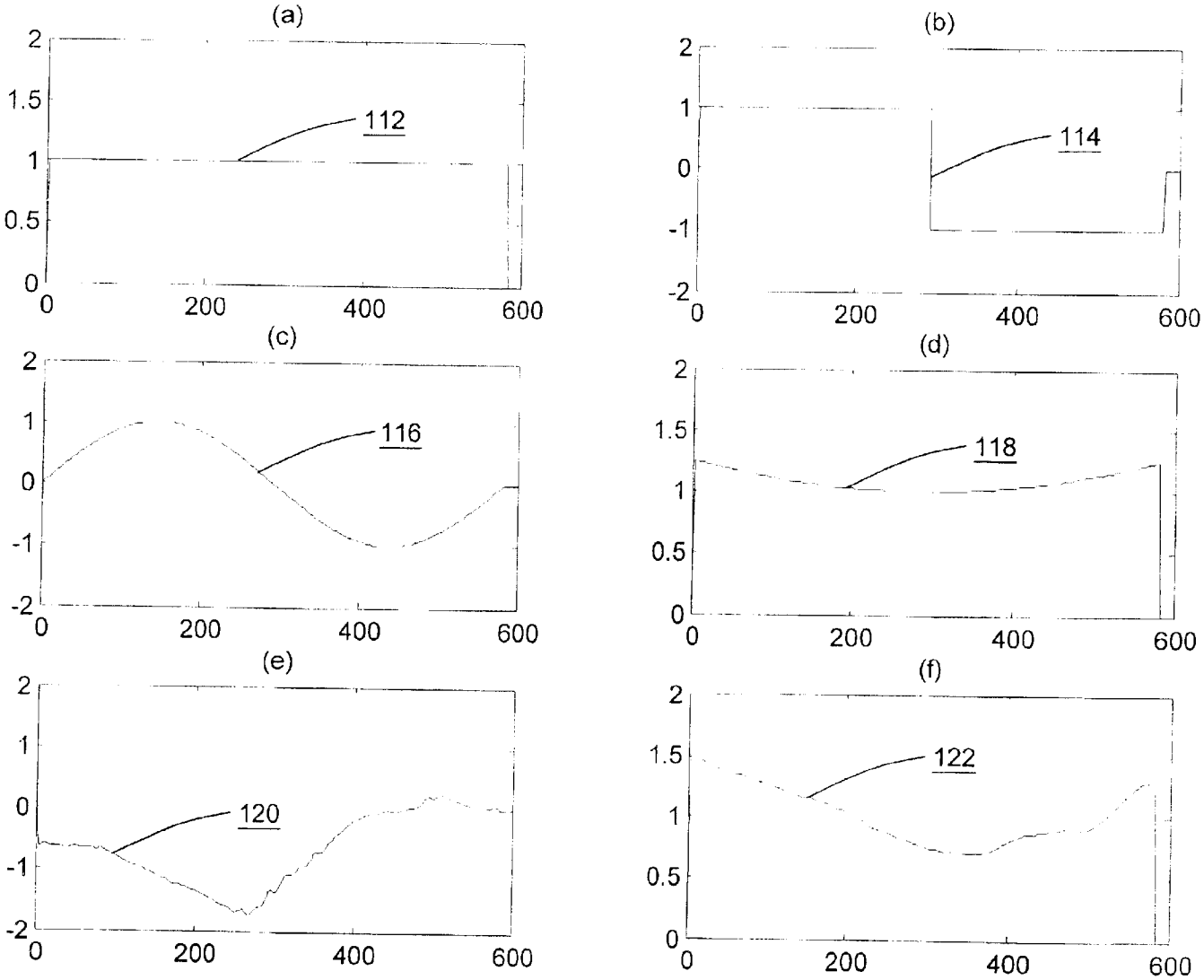
Fig. 9 Examples of reference functions (110)

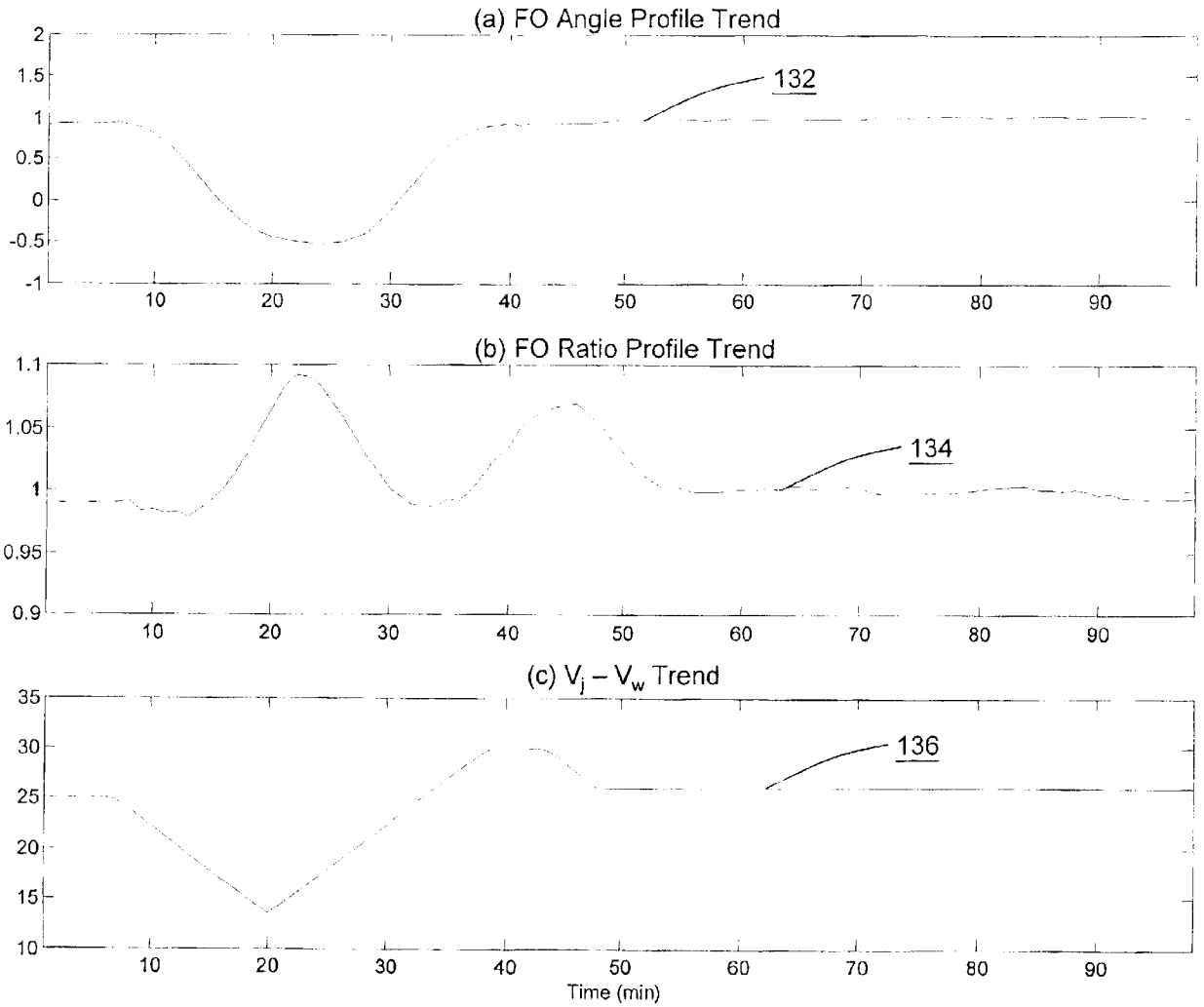
Fig. 10 Trends of FO indices and $V_{jw}$ (130)

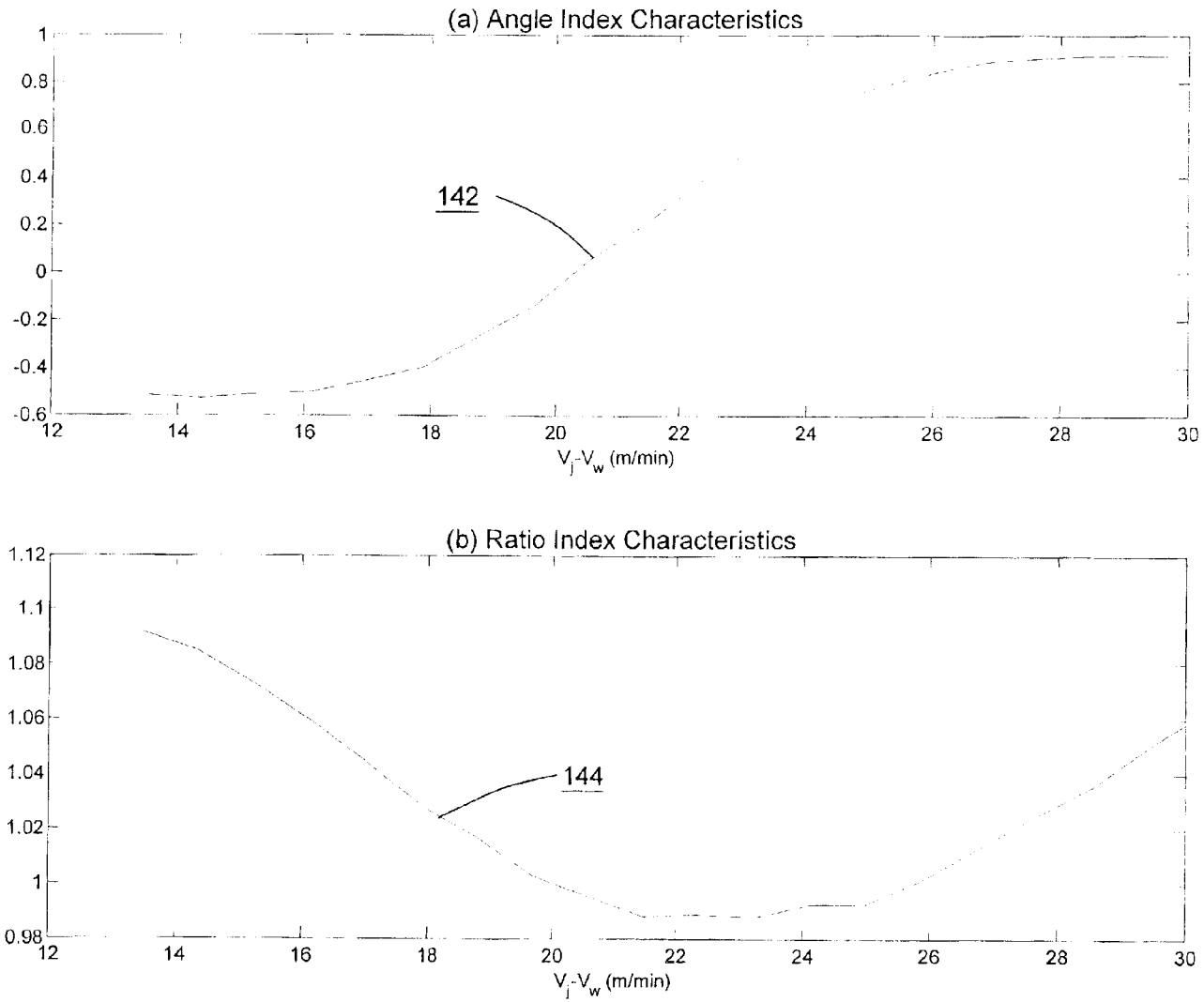
Fig. 11 FO process characteristics (140)

ON-LINE FIBER ORIENTATION CLOSED-LOOP CONTROL

FIELD OF THE INVENTION

This invention relates to on-line fiber orientation sensors and more particularly to the control of fiber orientation of a paper web using multiple measurements emanating from such sensors.

DESCRIPTION OF THE PRIOR ART

Fiber orientation in papermaking refers to the preferential orientation of the individual fibers on the web. Because of flow patterns in the headbox and the jet impingement on the wire, fibers have a tendency to align in the machine direction (MD) versus other directions in the web. For example, it is very easy to tear a square coupon from your daily newspaper in one direction, usually vertical, but not that easy to tear the coupon in the other direction as the newsprint sheet has more fibers aligned in the MD which is typically the vertical direction in a printed newspaper.

If all of the fibers in the web were perfectly distributed, the paper sheet would have the same properties in all directions. This is called an isotropic sheet and its fiber distribution can be plotted on a polar graph in the form of a circle. A fiber ratio, which is the ratio of maximum to minimum fiber distribution 90° apart, can be defined for a paper sheet. An isotropic sheet has a fiber ratio of one.

If there are more fibers in one direction than in other directions the fibers are distributed non-uniformly and the sheet is anisotropic. As shown in FIG. 6, the anisotropic fiber distribution can be plotted on a polar graph as a symmetrical ellipse-like geometric figure 72. An anisotropic sheet has a fiber ratio greater than one and with higher fiber ratios the polar distribution tends to be in the shape of a figure eight. The fiber ratio (anisotropy) is defined as the ratio of maximum to minimum distribution, 90° apart. The fiber angle $\alpha$ is defined as the angle of the major axis 76 of the ellipse 72 to the machine direction 74. FIG. 6 illustrates the definitions of FO ratio (the ratio of max 80 to min 82) and FO angle of fiber distribution in a paper sheet.

A fiber orientation (FO) sensor provides the measurement of the fiber angle and the fiber ratio of a paper sheet in both the temporal or machine direction (MD) and also the spatial or cross-machine direction (CD) when it measures across the moving paper web. Each FO scanning sensor can simultaneously produce four profiles of FO measurement. They are the FO angle profile and the FO ratio profile for the topside and the bottom side of the sheet. The typical FO profiles are illustrated in (a) [topside FO angle], (b) [topside FO ratio], (c) [bottom side FO angle] and (d) [bottom side FO ratio] of FIG. 7. These measurements are directly or indirectly linked to other sheet properties like strength and/or sheet curl and twist. One example of a FO sensor is described in U.S. Pat. No. 5,640,244, which issued on Jun. 17, 1997 the disclosure of which is hereby incorporated herein by reference. That patent is assigned to a predecessor in interest to the assignee of the present invention.

In many papermaking processes the flow pattern in the headbox and on the wire makes the fiber distribution on the topside of the web, known as the felt side, different from the fiber distribution on the bottom side of the web, known as the wire side. It is typical to have a larger value of fiber ratio on the wire side than on the felt side. The FO sensor can be designed to separately measure topside and bottom side fiber orientation distribution of the sheet. The bottom side fiber angle is defined looking from the topside to the bottom side.

Some papermaking processes incorporate multiple headboxes with each headbox contributing to a single layer or ply of the final paper sheet. In such a multi-ply configuration, the top and bottom fiber orientation measurements are influenced by completely different headboxes. In single headbox paper machines, the top and bottom fiber orientation measurements are influenced by the same headbox.

Adjusting headbox jet-to-wire speed difference ($V_{jw=vj}-V_w$) can change the FO distribution in a paper sheet. FIG. 8 shows how the FO measurements of one side of a sheet are affected by changing the jet-to-wire speed difference of one headbox. In FIGS. 8(*a*) and 8(*b*), both FO angle and ratio profiles are plotted as the contour map for a time period of approximately 100 minutes. The corresponding trend of jet-to-wire speed difference is also shown in FIG. 8(*c*).

It is advantageous to produce paper products with desired sheet strength and/or curl and twist specifications. The measurements provided by the on-line FO sensor may be used as the inputs to a controller to provide a closed-loop FO feedback control. The ultimate objective of FO control is to adjust the process so that the process can produce sheets with specific paper properties.

U.S. Pat. Nos. 5,022,965; 5,827,399 and 5,843,281 describe various methods and apparatus for controlling fiber orientation but do not disclose or even suggest the controller of the present invention.

The controller of the present invention provides a first step of closed-loop FO control, also known as base level FO control (BFOC). In this first step of FO control instead of achieving desired sheet properties such as strength and/or curl and twist, the BFOC attempts to achieve one or multiple indices that are derived from on-line FO measurements. These indices can for example be an average of FO profile, a tilt index of the measured profile, a concavity index of the measured profile, a signature index of a FO profile, or their combination. A generalized algorithm is provided to transform the raw fiber ratio and fiber angle profiles into these indices, which can be used for control of sheet-forming processes. These indices accentuate the temporal and/or spatial properties of the FO measurements of a manufacturing sheet.

An operator can use the controller of the present invention to produce paper products at different fiber ratio and/or fiber angle settings. Ultimately, with accumulation of experience and knowledge, the repeatable correlation between sheet properties and FO specifications will be established and a supervisory FO control will be created on top of this level of FO controller.

SUMMARY OF THE INVENTION

The current invention includes signal-processing methods to transform the FO profile measurements into meaningful indices and controllers to derive effective FO control actions. Originating from the FO sensors are top and bottom fiber angle and fiber ratio raw measurements. These raw measurements comprise vectors of multiple data box values representing FO properties at different cross directional points on the paper sheet. There are four such vectors made available at every completion of scanning at the edge of sheet and they represent profiles of top fiber angle, top fiber ratio, bottom fiber angle and bottom fiber ratio. As was described above, FIG. 7 illustrates typical four FO profiles obtained from a scanning FO sensor. In a generalized sense, these profiles can be treated as continuous functions of CD position. Each of these profiles is subject to filtering in the cross-direction using accepted windowing filters such as Hanning, Blackman, and wavelets. Such filtering techniques allow for capturing the dominant variation of the individual profile shapes.

In order to establish an effective indication of the impact from process adjustments, each FO profile vector can be transformed to a scalar value, which can serve as an index for the associated measurement. A scale index is obtained by convolving a measured FO profile function with a reference function. FIG. 9 shows several examples of reference functions such as the unit step function of FIG. 9(*a*) and the asymmetrical step function of FIG. 9(*b*). Here are four example indices which are used herein for the purposes of illustration and not limitation. The first index is an average of all the individual data points that are part of the profile. The second index is termed the tilting index of the profile. The third index reflects the concavity of the profile. The fourth index is called the signature index of the profile. Any combination of these indices can be used as an index of the FO measurement to provide a measured value for a controller.

The controller which is part of the current invention adjusts a manipulated variable to achieve a desired FO target associated with the inferred FO index and is named the base level fiber orientation control (BFOC). This controller is implemented as a single-stage fuzzy controller, a multi-stage fuzzy controller, or the combination of fuzzy controllers with non-fuzzy logic controllers. Using rule-based fuzzy techniques allows the controller to adapt to changing process conditions including a change in the sign of the process gain and non-linearity in the process gain. Each BFOC uses one or multiple FO inferred indices and targets to be achieved as the main inputs. The output from the BFOC is the incremental adjustments to manipulated variables such as headbox jet-to-wire speed difference, slice opening, slice screw settings, edge flows, and/or recirculation flows. Papermakers can attain different control objectives by utilizing the different combinations of derived FO indices.

DESCRIPTION OF THE DRAWING

FIG. 1 is a block diagram of the base level fiber orientation control system of the present invention.

FIG. 2 is a first embodiment for controller of the base level fiber orientation control system of FIG. 1.

FIG. 3 is a second embodiment for controller of the base level fiber orientation control system of FIG. 1.

FIG. 4 depicts a scheme to be used with a single headbox paper machine that affects a fiber orientation measurement for both the top and bottom sides of the sheet.

FIG. 5 shows a set of triangular membership functions for defining the input and output space of the linguistic variables for the embodiment of FIG. 2.

FIG. 6 depicts the definition of FO measurement.

FIG. 7 shows four typical FO profiles obtained from an on-line FO sensor after completing a full scan across paper sheet width.

FIG. 8 illustrates the contour plots of one hundred consecutive FO angle and ratio profiles from one side of paper sheet while the headbox jet-to-wire speed difference was changed in the same time interval.

FIG. 9 shows several examples of reference functions that can be used to transform the measured FO profiles to scalar indices.

FIG. 10 depicts the FO indices derived from the angle and ratio profiles in FIG. 8.

FIG. 11 illustrates the process characteristics of FO indices as non-linear function of the manipulated variable such as the jet-to-wire speed difference.

DESCRIPTION OF THE PREFERRED EMBODIMENT(S)

The main objective of BFOC is to achieve a desired fiber ratio index, a desired fiber angle index, or their combination. To perform BFOC, a number of variables need to be derived from the FO sensor measurements and the actuator loop. These variables are:

1. $r_p$ the filtered FO ratio profile;
2. $r_z$ a fiber ratio index derived from the filtered FO ratio profile $r_p$ obtained from a scan of the FO sensor across the moving paper web;
3. $e_r$ the deviation between a fiber ratio index target, $r_{tgt}$, and calculated fiber ratio index, $r_z$;
4. $\Delta r_z$ the difference of ratio indices between two consecutive control settings to actuators such as headbox jet-to-wire speed difference, slice opening, slice screw settings, edge flows, or recirculation flow;
5. $a_p$ the filtered FO angle profile;
6. $a_z$ a fiber angle index derived from the filtered FO angle profile $a_p$ obtained from a scan of the FO sensor across the moving paper web;
7. $e_a$ the deviation between fiber angle index target, $a_{tgt}$, and calculated fiber angle index, $a_z$;
8. $\Delta a_z$ the difference of the angle indices between two consecutive control settings to actuators such as headbox jet-to-wire speed difference, slice opening, slice screw settings, edge flows, or recirculation flow;
9. $\Delta x$ the difference between two consecutive manipulated variable settings, such as headbox jet-to-wire speed difference, slice opening, slice screw settings, edge flows, recirculation flow, or other control actions that have measurable impacts on FO measurement; and
10. $\Delta u$ the requested change in the manipulated variable, such headbox jet-to-wire speed difference, slice opening, slice screw settings, edge flows, recirculation flow or other control actions that have measurable impacts on FO measurement.

FIG. 1 depicts a block diagram for the BFOC system 10 in accordance with the present invention. Using FIG. 1 as a reference, the fiber orientation sensor 24 typically scans across a paper web to provide four measurement profiles at the end of every scan. These profiles are top fiber angle, top fiber ratio, bottom fiber angle and bottom fiber ratio as indicated by plots 92, 94, 96, and 98 respectively in FIG. 7. Each measurement profile can be filtered by filter block 26 in order to eliminate high frequency variations and allow the controllable variation of the measurement profiles to be captured. The type and the degree of filtering provided by filter block 26 are selectable by the user. The output of filter block 26 is the filtered fiber ratio profile (or vector) $r_p$ and the filtered fiber angle profile (or vector) $a_p$. While FIG. 1 shows filter block 26 it should be appreciated that some applications may not require filtering of the measurement profiles.

The filtered (or if filtering is not needed in system 10 measured only) fiber angle and fiber ratio profiles (or vectors) $r_p$ and $a_p$ are transformed to different scalar indices by FO indices transform block 14. The resulting indices are $r_z$ and $a_z$. Several transformations to derive the indices $r_z$ and $a_z$ are detailed below using the fiber ratio profile measurement $r_p$ as the example. The same transformations can however be applied equally to the fiber angle profile measurement $a_p$.

In a general form, each FO profile can be transformed into a scalar index by the following transformation:

$$y = \frac{\int_{z_1}^{z_2} p(z)h(z)dz}{\int_{z_1}^{z_2} h^2(z)dz} \tag{1}$$

where z is a CD location relative to a CD coordinate and $z_1$ and $Z_2$ are sheet edge locations along the same CD coordinate, p(z) is the measurement of a FO profile at CD location z and h(z) is a reference function. The reference function h(z) can be a unit step function, an asymmetric unit step function, a sinusoidal function, a polynomial function, or their combinations defined between two sheet edge locations $z_1$ and $z_2$. FIG. 9, described below, shows several examples of these functions.

Depending on the reference function selected, the derived index accentuates different components of variations in the measured FO profiles. Regardless of which reference profile functions are used, the indices in the above definition are all normalized.

While certain transformations are described below to derive the indices, it should be appreciated that other transformations may also be used for that purpose.

Index 1: $r_m$ Mean of a Measured Profile

If the reference function is a unit step function between two sheet edge locations $z_1$ and $z_2$ as expressed by 112 of FIG. 9(*a*), the derived index $r_m$ is the mean of a measured profile and is computed as the average of the measured fiber ratio vector $r_p$. In discrete form, this index is a function of an inner product of the measured fiber ratio vector $r_p$ and a uniform vector $h_1$ with all of its elements equal to 1.

$$r_m = \frac{\sum_{i=1}^{n} r_{pi}}{n} = \frac{1}{n}[r_{p1} \quad r_{p2} \quad r_{p3} \quad \cdots \quad r_{pn}]\cdot[1 \quad 1 \quad 1 \quad \ldots \quad 1]^T \tag{2}$$

-continued $$= \frac{1}{n} r_p h_1^T$$

where $h_1$=[1 1 1 . . . 1] and n is the number of data points of the measured profile.

This index is associated with the machine direction variation of the measured profile. This index is not representative of changes to the shape of the measured profile.

Index 2: $r_t$ Tilt of a Measured Profile

If the reference function is an asymmetric unit step function between two sheet edge locations $z_1$ and $z_2$ as shown by 114 in FIG. 9(*b*), the derived index $r_t$ of $r_p$ indicates the severity of profile tilting. In a discrete form, the tilt index $r_t$ is computed as an inner products of $r_p$ and $h_2$ by:

$$r_t = \frac{r_p h_2^T}{h_2 h_2^T} \tag{3}$$

where $h_2$=[1 1 . . . 1−1 . . . −1−1] is shown by 114 or is a sinusoidal function as indicated by 116 of FIG. 9(*c*). Other general cases can easily be derived from the similar concept.

The tilt index provides an indication of the tilt of the profile with the sign of the index providing the direction of the tilt.

This index is more relevant to the fiber angle profile measurement since the inherent nature of paper fiber orientation on a web causes one contiguous section of the profile to have values above the mean value and the other contiguous portion of the profile to be distributed below the mean value.

Index 3: $r_c$ Concavity of a Measured Profile

If the reference function is a quadratic function between two sheet edge locations $z_1$ and $z_2$, as shown by 118 in FIG. 9(*d*), the derived concavity index $r_c$ of $r_p$ accentuates the concavity of the measured profile. Expressing in a discrete form, the concavity index $r_c$ is computed as a function of an inner product of $r_p$ and a vector $h_3$:

$$r_c = \frac{r_p h_3^T}{h_3^T h_3} \tag{4}$$

where $h_3$ is a quadratic function as shown by 118 of FIG. 9. Other general cases can easily be derived from the similar concept.

The concavity index provides a severity indication of the concave shape of the profile.

This index is more relevant to the fiber ratio profile measurement since the inherent nature of paper fiber orientation is as the result of flow pattern exiting from a headbox.

Index 4: $r_s$ Signature of a Measured Profile

To obtain a signature index $r_s$ of a measured profile requires first establishing a reference (or signature) profile function from a set of steady-state measured profiles. Assume a matrix $r_0$ represents a collection of k consecutive steady-state measured FO profiles where each row is a measured profile composed of n measured points from consecutive CD positions on the paper sheet. The signature profile (or vector) $h_4$ is calculated as the averaged profile of those k consecutive steady-state measured profiles. Functions 120 and 122 of FIGS. 9(*e*) and (*f*), respectively, represent the examples of signature functions for FO angle and ratio profiles respectively.

In a discrete form, the signature index $r_s$ is calculated as a function of an inner product of the measured profile and the established signature profile, $$r_s = \frac{r_p h_4^T}{h_4 h_4^T} \tag{5}$$

where $h_4$ is the signature profile established from a set of steady-state measured profiles. Depending on the controllability of the measured profiles, a CD filter can be applied to the signature profile $h_4$ as needed.

This index captures some combined variability of the measured profile. Calculation of the signature profile can be initiated by users and hence allows specific and perhaps optimal paper sheet conditions to be established as a reference function. Subsequent deviations from these conditions are reflected in the signature index derived from the reference (signature) function. Using this index and an appropriate target, it is possible for a closed loop controller to achieve a desired target that is associated with the sheet conditions.

To generalize the indices derived from the FO ratio profiles, a common expression $r_z$, where the subscript z is either m, c, t, or s, can be used to represent the indices described in the equations (2) to (5). Similarly, for the measured fiber angle profile $a_p$, the corresponding generalized indices can be represented as $a_z$ where z is either in, c, t, or s, $r_z$ and $a_z$ represent the generalized indices outputs from block 14 of FIG. 1 as the results of the index transformation of the measured fiber ratio and fiber angle profiles $r_p$ and $a_p$. In general cases, equation (1) can be applied to make any combination of the above indices or other meaningful indices.

As an example, the FO angle and ratio profiles 102 and 104, respectively, as indicated in FIGS. 8(*a*) and 8(*b*), respectively, are transformed with signature reference functions 120 and 122 of FIGS. 9(*e*) and 9(*f*) into their corresponding signature indices 132 and 134 of FIGS. 10(*a*) and (*b*), respectively. The same transformation can be applied for both top and bottom FO profiles.

With the indices derived from on-line FO measurements, the process characteristics can be expressed in simpler models. Taking the example illustrated in FIG. 10, the relationship between FO indices 132 and 134 of FIG. 10 and the headbox jet-to-wire speed difference 136 of FIG. 10(*c*) can be shown by process characteristics 142 and 144 in FIGS. 11(*a*) and 11(*b*), respectively. Characteristics 142 and 144 of FIG. 11 show the non-linearity of FO process gains with respect to jet-to-wire speed difference ($V_{jw}$) The illustrated process gains numerically vary as the machine conditions change. We have found that the process characteristics appearing in FIG. 11 are repeatable on variety of paper machines.

For different types of paper, there are different objectives to control FO distribution in paper sheet. For printing and copying paper, reducing paper curl and twist is the goal of FO control. For multi-ply board and kraft paper, the need of FO control is to improve paper strength and reducing sheet dimensional stability. These control objectives are indirectly translated into different sets of FO indices. In practice, the typical goal of FO control is either eliminating FO angle profile shape or reducing overall FO ratio level to near an isotropic sheet.

A FO control is required to handle the non-linearity of process characteristics as shown in FIG. 11 and to have a full flexibility for papermakers to select their different control objectives. A rule-based fuzzy closed-loop loop FO control (BFOC) is designed to meet these practical needs.

As is shown in FIG. 1, BFOC 12 receives the target inputs $r_{tgt}$ and $a_{tgt}$; the inputs $r_z$ and $a_z$ from the output of FO indices transform 14; the inputs $\Delta r_z$ and $\Delta a_z$ also from the output of FO indices transform 14; and from differentiator 16 the input $\Delta_x$. BFOC 12 uses the inputs $r_{tgt}$ and $r_z$ to determine er and the inputs $a_{tgt}$ and $a_z$ to determine ea. The output $\Delta u$ of BFOC 12 is connected as one of the two inputs to summer 18 which has its other input connected to the control setpoint u either from operator entry or other controllers.

The total output of the summer 18 is sent through limiter 28 before it is applied as a setpoint demand for the actuator loop 20. Actuator loop 20 has its output directed to papermaking process 22 and to the input of differentiator 16. Process 22 has its output paper web measured by the FO sensor 24, which provides the measured fiber ratio and fiber angle profiles $r_p$ and $a_p$ to FO indices transform 14.

The targets $r_{tgt}$ and $a_{tgt}$ are established with a bumpless transfer scheme. While the BFOC system 10 is in the manual mode of operation, these targets are calculated as a moving average of current FO measurement indices. When the BFOC system 10 is turned to the automatic mode of operation, these calculated targets become the initial targets for the BFOC system 10. Subsequent changes entered by the operator can be either an absolute or incremental entry.

The BFOC system 10 can be implemented with various control techniques such as fuzzy control methods. Two embodiments for BFOC system 10 implemented using fuzzy control methods are described below in connection with FIGS. 2 and 3.

Referring now to FIG. 2, there is shown one embodiment for BFOC 12 where controller 12 is implemented as a two-stage controller system 30. In controller system 30, the first stage is made up of two controllers 32 and 34. Both controllers 32 and 34 are implemented as fuzzy controllers with two inputs and one output. The output of controllers 32 and 34 are the required manipulated variable adjustments. In controller system 30, the second stage is a fuzzy controller 36 also with two inputs and one output. The output of controller 36 is the combination of the required manipulated variable adjustments from controllers 32 and 34.

The fuzzy controllers 32 and 34 in the first stage are designed to eliminate deviation of FO variables from their desired targets and as a nonlinear adaptive controller. These design objectives are achieved by the careful selection of the input linguistic variables and definition of the fuzzy rule set. The first stage fuzzy controllers 32 and 34 are similar in construction. The distinguishing difference between the two fuzzy controllers 32 and 34 is the selection of the input linguistic variables. In general, the input and output linguistic variables for fuzzy controllers 32 and 34 can be stated as Input Linguistic Variables:

| | |
|---|---|
| Input 1: | $\Delta y/\Delta x$ - the change in FO index $\Delta y$, which can be either $\Delta r_z$ or $\Delta a_z$, relative to the actual change in manipulated variable $\Delta x$. |
| Input 2: | $e_y$ - the deviation of the FO index from desired target. $e_y$ can be either $e_r$ or $e_a$. |

Output Linguistic Variables:

| | |
|---|---|
| Output: | $\Delta u_y$ - the desired change in manipulated variable. $\Delta u_y$ can be either $\Delta u_r$ or $\Delta u_a$. |

In the above linguistic variables,

| | |
|---|---|
| $\Delta y$ | denotes the change in the FO index between two consecutive program execution instances. As shown in FIG. 2, $\Delta y$ is $\Delta r_z$ for the fiber ratio index difference and $\Delta a_z$ for the fiber angle index difference, |
| $e_y$ | denotes the deviation of the FO variable from its target value. As shown in FIG. 2, $e_y$ is $e_r$ for the fiber ratio index deviation and $e_a$ for the fiber angle index deviation, |
| $\Delta x$ | denotes the actual change in the manipulated variable, such as headbox jet-to-wire speed difference, slice opening, slice screw settings, edge flows, or recirculation flow, and |
| $\Delta u_y$ | denotes the desired change in the manipulated variable, such as headbox jet-to-wire speed difference, slice opening, slice screw settings, edge flows, or recirculation flow. |

Specific to fuzzy controller 32 which is the controller for the fiber ratio index $r_z$, the input and output linguistic variables are

| | |
|---|---|
| Input 1: | $\Delta r_z/\Delta x$ - the change in fiber ratio index relative to actual change in the manipulated variable. |
| Input 2: | $e_r$ - the fiber ratio index deviation from desired target. |
| Output: | $\Delta u_r$ - the desired change in manipulated variable. |

Specific to fuzzy controller 34 which is the controller for fiber angle index $a_z$, the input linguistic variables are

| | |
|---|---|
| Input 1: | $\Delta a_z/\Delta x$ - the change in fiber angle index relative to actual change in the manipulated variable. |
| Input 2: | $e_a$ - the fiber angle index deviation from desired target. |
| Output: | $\Delta u_a$ - the desired change in manipulated variable. |

Since fuzzy controllers 32 and 34 are similar, these first stage fuzzy controllers can now be described in further detail and in a general sense. In controllers 32 and 34, $\Delta y/\Delta x$ that is $\Delta r_z/\Delta x$ for controller 32 and $\Delta a_z/\Delta x$ for controller 34, is updated according to the actual changes of x. If $\Delta x$ is too small, $\Delta y/\Delta x$ that is $\Delta r_z/\Delta x$ and/or $\Delta a_z/\Delta x$, is replaced programmatically with zero to avoid the impact of process uncertainty, measurement noise, and any other unknown factors.

The fuzzy controllers 32 and 34 are designed to eliminate deviation of FO variables from their desired targets and as an adaptive controller can each be illustrated by a system with five membership functions for each of the two fuzzy inputs and the fuzzy output. A system with this quantity of membership functions constitutes an example of a 5-by-5 fuzzy controller that has a total of 25 corresponding antecedent-consequence fuzzy rules. The linguistic descriptions and values for each of the two inputs and the output can be stated as:

"Large Negative (LN)"=−1.0

"Small Negative (SN)"=−0.5

"Zero (Z)"=0.0

"Small Positive (SP)"=+0.5

"Large Positive (LP)"=+1.0

To completely define the input and output space of the linguistic variables, an input set 62 and an output set 64 of triangular membership functions 60 as shown in FIG. 5 can be used as an example.

A representative set of antecedent-consequence fuzzy rules that applies to controllers 32 and 34 can be specified to fulfill the design requirement of the controller. For the row designated by the "large negative (LN)" linguistic description, the five corresponding rules can be stated as:

1. If "$\Delta y/\Delta x$ is large negative (LN)" and "$e_y$ is large negative (LN)", then "$\Delta u_y$ is large positive (LP)".
2. If "$\Delta y/\Delta x$ is small negative (SN)" and "$e_y$ is large negative (LN)", then "$\Delta u_y$ is large positive (LP)".
3. If "$\Delta y/\Delta x$ is zero (Z)" and "$e_y$ is large negative (LN)", then "$\Delta u_y$ is zero (Z)".
4. If "$\Delta y/\Delta x$ is small positive (SP)" and "$e_y$ is large negative (LN)", then "$\Delta u_y$ is large negative (LN)".
5. If "$\Delta y/\Delta x$ is large positive (LP)" and "$e_y$ is large negative (LN)", then "$\Delta u_y$ is large negative (LN)".

Continuing with the fuzzy design process, the remaining 20 antecedent-consequence fuzzy rules can also be stated in the same format. Without loss of detail, the complete set of antecedent-consequence fuzzy rules can be expressed in a rule table:

| Input 2 - $e_y$ | | | | | | |
|---|---|---|---|---|---|---|
| | LP | LN | LN | Z | LP | LP |
| | SP | SN | SN | Z | SP | SP |
| | Z | Z | Z | Z | Z | Z |
| | SN | SP | SP | Z | SN | SN |
| | LN | LP | LP | Z | LN | LN |
| | | LN | SN | Z | SP | LP |
| | | | Input 1 - $\Delta y/\Delta x$ | | | |

In combination, the selection of input 1 ($\Delta y/\Delta x$) and the rule set adapts controllers 32 and 34 for different process responses. In combination, the selection of input 2 ($e_y$) and the rule set controls the FO variables to the desired targets. In the rule table, if the row and column designated by the "zero" linguistic description are considered the zero axes, then the rule table can be viewed as having four (4) quadrants. The $1^{st}$ quadrant (top right) adapts the controller for the case of positive target deviations (FO variable below the target value) and with a process response that is positive.

The $2^{nd}$ quadrant (top left) adapts the controller for the case of positive target deviations (FO variable below the target value) and with a process response that is negative. The $3^{rd}$ quadrant (bottom left) adapts the controller for the case of negative target deviations (FO variable above the target value) and with a process response that is negative. The $4^{th}$ quadrant (bottom right) adapts the controller for the case of negative target deviations (FO variable above the target value) and with a process response that is positive.

The fuzzy controller 36 in the second stage is designed to make a trade-off between the two manipulated variable requests from the first stage controllers 32 and 34. The outputs $\Delta u_r$ and $\Delta u_a$ from the two fuzzy engines 32 and 34, respectively, are fed to the second stage fuzzy engine 36 which makes the trade-off between the two manipulated variable requests from the first stage. The trade-off between the two manipulated variable requests can be specified by a rule set. In general, the input and output linguistic variables for fuzzy controller 36 can be stated as Input Linguistic Variables:

| | |
|---|---|
| Input 1: | $\Delta u_r$ - the desired change in the manipulated variable from controller 32. |
| Input 2: | $\Delta u_a$ - the desired change in the manipulated variable from controller 34. |

Output Linguistic Variables:

| | |
|---|---|
| Output: | $\Delta u$ - the final desired change in the manipulated variable. |

Exercising fuzzy control design methods, linguistic descriptions, linguistic values and antecedent-consequence rules can be established for controller 36. Without design details, the workings of fuzzy controller 36 can be summarized in a rule table, where the represented linguistic descriptions and values are the same as those defined for controllers 32 and 34:

| | | | | | | |
|---|---|---|---|---|---|---|
| Input 2 - $\Delta u_a$ | LP | Z | SP | SP | LP | LP |
| | SP | SN | Z | SP | SP | LP |
| | Z | SN | SN | Z | SP | SP |
| | SN | LN | SN | SN | Z | SP |
| | LN | LN | LN | SN | SN | Z |
| | | LN | SN | Z | SP | LP |
| | | | | Input 1 - $\Delta u_r$ | | |

In the rule table, the main diagonal is assigned the linguistic value corresponding to "zero (Z)" change to account for opposing desired changes from controllers 32 and 34. The upper triangle (top right) is assigned linguistic values corresponding to "positive (SP and LP)" changes to account for the dominating positive changes originating from both controllers 32 and 34. In the upper triangle, the linguistic values progressively increases to "large positive (LP)" to reflect that the universe of discourse at the extreme point for input 1 ($\Delta u_r$) and input 2 ($\Delta u_a$) are both "large positive (LP)". Applying similar logic as used for specifying the rules in the upper triangle, the lower triangle (bottom left) is assigned linguistic values corresponding to "negative (SN and LN)" changes to account for the dominating negative changes originating from both controllers 32 and 34.

Referring now to FIG. 3, there is shown an alternative embodiment for BFOC 12 where controller 12 is implemented as a two stage controller system 40. In this embodiment, controllers 42 and 44 are the same as controllers 32 and 34, respectively. In place of the second stage fuzzy controller 36, controller system 40 realizes the final desired change in the manipulated variable ($\Delta u$) as a non-fuzzy weighted combination of the required manipulated variable adjustments $\Delta u_r$ and $\Delta u_a$ from first stage controllers 42 and 44, respectively. One example of this weighted combination can be expressed as $$\Delta u=(w_r*\Delta u_r)+(w_a*\Delta u_a) \tag{6}$$

where

| | |
|---|---|
| $\Delta u_r$ and $\Delta u_a$ | are the required manipulated variable adjustments from the first stage controllers 42 and 44, respectively, |
| $w_r$ and $w_a$ | are weighting magnitudes applied to $\Delta u_r$ and $\Delta u_a$, respectively, |
| $\Delta u$ | is the final desired change in the manipulated variable. |

The weighting magnitudes $w_r$ and $w_a$ are specified such that the equality $$w_r+w_a=1 \tag{7}$$

is satisfied.

For a BFOC system controlling more than two indices with one manipulated variable, a generalized weighted sum such as:

$$\Delta u = \sum_{i=1}^{l} \Delta u_i w_i \text{ with } \sum_{i=1}^{l} w_i = 1 \tag{8}$$

or multiple stages of rule-based fuzzy controllers 30 can be applied.

In paper making processes with multiple headbox configurations, the top and bottom ply are each associated with a dedicated headbox which forms that layer of the paper sheet. In this case, either the embodiment of FIG. 2 or the embodiment of FIG. 3 of the BFOC can be configured and associated with the top and bottom fiber measurement independently. The output of each controller is dispatched to the actuator associated with the corresponding headbox.

FIG. 4 illustrates a mechanism 50 to address a single headbox paper machine, which also has a fiber measurement for the top and bottom sides of the sheet. In this case either the embodiment of FIG. 2 or the embodiment of FIG. 3 of the BFOC can be configured and associated with the top and bottom fiber measurement.

There is however only one actuator associated with the headbox. Once again a fuzzy controller similar to 36 or a weighted combination of the outputs from the BFOC associated with the top and bottom can be used to generate a single $\Delta u$ output for the headbox actuator. As is depicted in FIG. 4, the Top $\Delta u$ output from the top measurement and its associated BFOC and the Bottom Δu output from the bottom measurement and its associated BFOC are weighted using the tunable weighting factors 52 and 54 to yield a single Δu to be dispatched to the headbox actuator after limit checking.

In single headbox paper machines an alternate method of combining the top and bottom fiber measurements to produce a single fiber ratio and fiber angle profile can also be used in conjunction with a single BFOC.

To gain a desired resolution for each fuzzy controller, the scaling factors for inputs and outputs in each control iteration can be adjusted according to the magnitude of $e_y$ and Δy/Δx.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method for closed loop control of fiber orientation of a moving web being formed on a papermaking machine comprising:

a) performing on said moving web being formed on said papermaking machine on-line measurements of said fiber orientation;

b) transforming said on-line measurements to a plurality of indices;

c) comparing each of said plurality of indices arising from said transformed on-line measurements with an associated target and deriving therefrom a deviation for each of said plurality of indices from said associated target;

d) computing actions for controlling said fiber orientation based on said derived deviations and a response characteristic of said process; and e) executing said control actions to minimize said derived deviations.

2. The method of claim 1 wherein said method further comprises obtaining from said on-line measurements of said fiber orientation a plurality of vectors each of which represent an associated one of a plurality of fiber orientation profiles and said transforming step includes transforming each of said plurality of vectors to an associated one of said plurality of indices.

3. The method of claim 2 wherein each of said plurality of fiber orientation profiles p(z) is transformed by the equation:

$$y = \frac{\int_{z_1}^{z_2} p(z)h(z)dz}{\int_{z_1}^{z_2} h^2(z)dz}$$

with a selected reference function h(z) to produce an associated one of said plurality of indices.

4. The method of claim 3 wherein each of said plurality of fiber orientation profiles has individual data points and one of said plurality of indices is an average of all of said individual data points that are part of said associated one of said plurality of vectors.

5. The method of claim 3 wherein another of said plurality of indices is an indication of the tilting of said associated one of said plurality of vectors.

6. The method of claim 3 wherein another of said plurality of indices is an indication of the concavity of said associated one of said plurality of vectors.

7. The method of claim 3 wherein another of said plurality of indices is a signature of the variability of said associated one of said plurality of vectors.

8. The method of claim 1 wherein said computing is responsive to said plurality of deviations of indices from said associated targets as inputs for computing one of said control actions as an output.

9. The method of claim 8 wherein said computing comprises the step of using logic selected from fuzzy or non-fuzzy logic or any combination thereof for computing one of said control actions.

10. The method of claim 9 wherein said fuzzy logic comprises at least two of said inputs and one of said output with a plurality of fuzzy rules and a plurality of membership functions associated to each linguistic descriptions.

11. The method of claim 9 wherein said non-fuzzy logic comprises at least a mathematical operation of a weighted sum of a plurality of said inputs for computing one of said control actions.

12. The method of claim 8 wherein said computing comprises using a plurality of logic stages for computing one of said control actions.

13. The method of claim 12 wherein said of using a plurality of logic stages comprises implementing each of said plurality of logic stages as logic selected from fuzzy or non-fuzzy logic or any combination thereof.

14. The method of claim 12 wherein said plurality of logic stages comprises two fuzzy logic stages.

15. The method of claim 12 wherein said plurality of logic stages comprises at least one stage that is fuzzy logic and at least one other stage that is non-fuzzy logic.

16. The method of claim 1 wherein said executing comprises applying said control actions to control a papermaking machine having one or more headboxes.

17. An apparatus for closed loop control of fiber orientation of a moving web being formed on papermaking machine comprising:

a) means for performing on said moving web being formed on said papermaking machine on-line measurements of said fiber orientation;

b) means for transforming said on-line measurements to a plurality of indices;

c) means for comparing each of said plurality of indices arising from said transformed on-line measurements with an associated target and deriving therefrom a deviation for each of said plurality of indices from said associated target;

d) means for computing actions for controlling said fiber orientation based on said derived deviations and a response characteristic of said process; and e) means for executing said control actions to minimize said derived deviations.

18. In combination:

a machine for making paper; and apparatus for closed loop control of fiber orientation of a moving web being formed on said papermaking machine comprising:

a) means for performing on said moving web being formed on said papermaking machine on-line measurements of said fiber orientation;

b) means for transforming said on-line measurements to a plurality of indices;

c) means for comparing each of said plurality of indices arising from said transformed on-line measurements with an associated target and deriving therefrom a deviation for each of said plurality of indices from said associated target;

d) means for computing actions for controlling said fiber orientation based on said derived deviations and a response characteristic of said process; and e) means for executing said control actions to minimize said derived deviations.

* * * * *